US010562596B1

(12) United States Patent
Tennler

(10) Patent No.: US 10,562,596 B1
(45) Date of Patent: Feb. 18, 2020

(54) FLOATING AND / OR STORABLE PLATFORM FOR MOUNTING ELECTRICAL AND / OR MECHANICAL AND / OR PNEUMATIC COMPONENTS

(71) Applicant: Claus Tennler, Nuremberg (DE)

(72) Inventor: Claus Tennler, Nuremberg (DE)

( * ) Notice: Subject to any disclaimer, the term of this patent is extended or adjusted under 35 U.S.C. 154(b) by 0 days.

(21) Appl. No.: 16/167,335

(22) Filed: Oct. 22, 2018

(30) Foreign Application Priority Data

Sep. 28, 2018 (DE) ..... 10 2018 124 054

(51) Int. Cl.
*B63B 21/02* (2006.01)
*H01F 7/20* (2006.01)
*B63B 35/44* (2006.01)

(52) U.S. Cl.
CPC ..... *B63B 21/02* (2013.01); *B63B 35/44* (2013.01); *H01F 7/20* (2013.01)

(58) Field of Classification Search
CPC ..... B63B 21/02; B63B 35/44; H01F 7/20
See application file for complete search history.

(56) References Cited

U.S. PATENT DOCUMENTS 10,047,717 B1 * 8/2018 Phillips ..... H02K 7/1892
2012/0187693 A1 * 7/2012 Houvener ..... F03B 17/061 290/54
2013/0199792 A1 * 8/2013 Backes ..... E21B 43/0122 166/335

* cited by examiner

*Primary Examiner* — S. Joseph Morano
*Assistant Examiner* — Jovon E Hayes
(74) *Attorney, Agent, or Firm* — Flener IP & Business Law; Zareefa B. Flener; Ayhan E. Mertogul

(57) ABSTRACT

The invention relates to a floatingly mounted and/or mountable platform for the assembly of electrical and/or mechanical and/or pneumatic structural elements in an area of water. It comprises, on the one hand, at least one platform which has at least one floating body or which forms the floating body itself, the floating body being designed such that it always holds an assembly upper side of the platform above a water level in order to be able to mount the electrical and/or mechanical and/or pneumatic structural elements on a surface of the assembly upper side. On the other hand, the invention comprises at least one anchoring element which is mounted on a floor region of a body of water below and distanced from the platform, i.e. below the water level. The invention is characterised in that both the anchoring element and the platform each have at least one magnet element such that the platform is held in the vertical direction by the anchoring element preferably only by the magnetic force that is generated between the two magnet elements.

12 Claims, 4 Drawing Sheets

Figure 1:
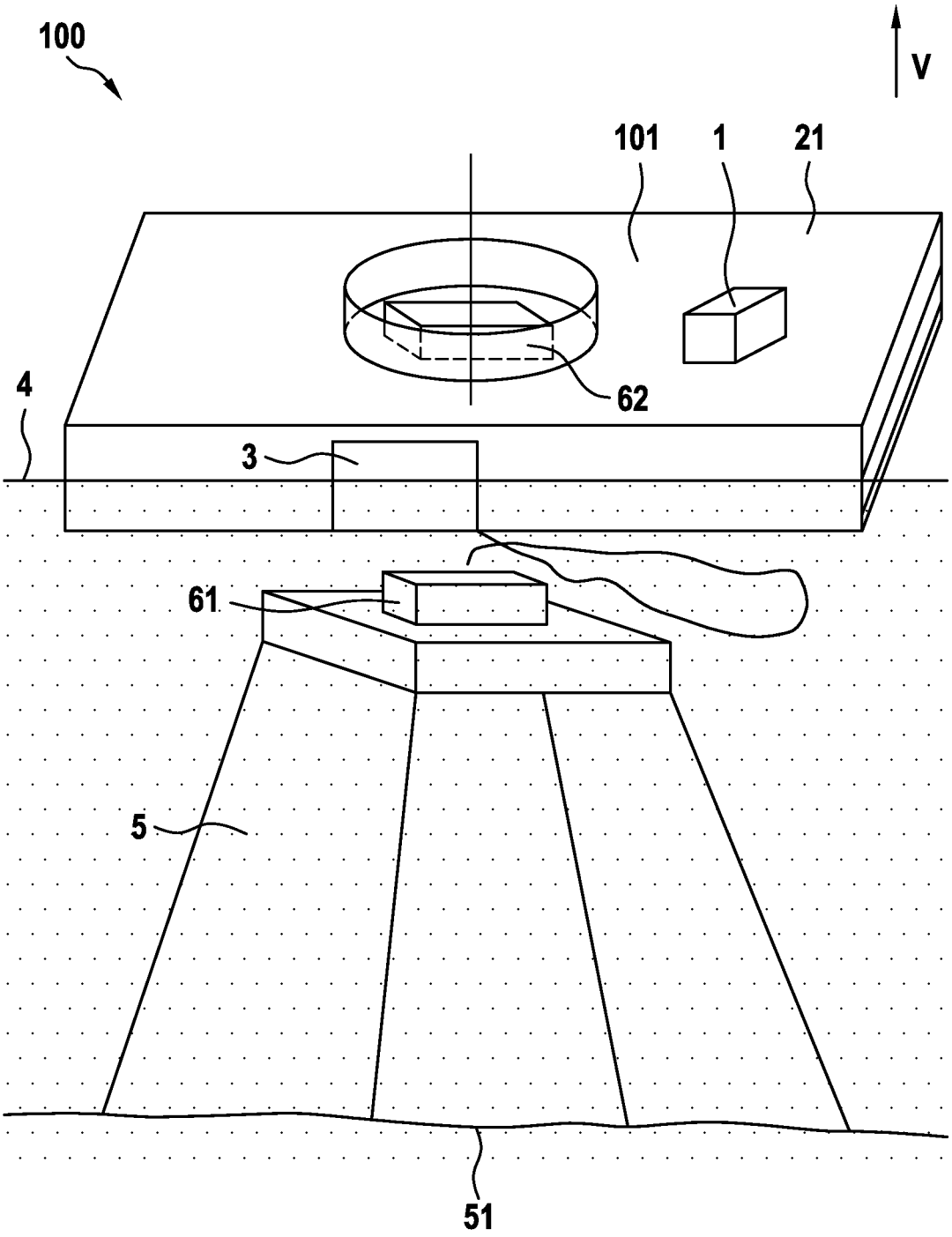

FLOATING AND / OR STORABLE PLATFORM FOR MOUNTING ELECTRICAL AND / OR MECHANICAL AND / OR PNEUMATIC COMPONENTS

The present invention relates to a floatingly mounted and/or mountable platform for the assembly of electrical and/or mechanical and/or pneumatic structural elements according to the subject matters of the independent claims 1 and 9.

Platforms mounted on an area of water up to now, in particular platforms that have been floatingly mounted and/or mountable on an area of water up to now are mechanically anchored using an anchoring element. To this end, the anchoring element is usually sunk to the floor region of a body of water and the floatingly mounted platform is connected to the anchoring element by mechanical connection elements, for example rods so that the platform cannot float away from the anchoring element by itself.

Other mountings for fixing such a platform can be located in connection means located above a water level of the body of water. Such connection means can for example also be a rod or rope which are formed with a strut or other elements fixed relative to the body of water.

Such fixings known from the prior art up to now are, however, not only complex, but are also maintenance-intensive and also lack adjustability. Based on this, it is therefore an object of the present invention to provide a floatingly mounted and/or mountable platform for the assembly of electrical and/or mechanical and/or pneumatic structural elements which is mountable in a particularly simpler and more cost-effective manner not only in a body of water, but is also quite particularly easily adjustable and is in particular arranged so as to be displaceable and/or tiltable in the body of water.

This object is achieved by the subject matters of claims 1 and 9. The floatingly mounted and/or mountable platform proposed here has at least one platform which has at least one floating body or which forms the floating body itself, the floating body being designed such that it always holds an assembly upper side of the platform above the water level in order to be able to mount the electrical and/or mechanical and/or pneumatic structural elements on a surface of the assembly upper side.

The platform proposed here also comprises at least one anchoring element which is mounted on a floor region of a body of water below the platform and distanced therefrom, i.e. below the water level. In this case, the term "body of water" designates any area surrounding a volume of water, including ponds, rivers and swimming pools, etc.

According to the invention, both the anchoring element and the platform have at least one magnet element such that the platform is held in the vertical direction by the anchoring element preferably only by the magnetic force that is generated between the two magnet elements.

This may mean that a connection between the anchoring element and the platform is without a connection rod. In particular, in addition to the magnet, only at least one breeching can be arranged between the anchoring element and the platform. This breeching, however, does not per se form such a connection which keeps the positioning of the anchoring element constant relative to the platform, but rather merely stops the platform from drifting away in the case of strong flow rates and in the case where the magnetic securing force between the two magnets breaks off. Such a breeching is preferably loosely arranged between the anchoring element and the platform.

According to at least one embodiment, the floatingly mounted and/or mountable platform for the assembly of electrical and/or mechanical and/or pneumatic structural elements within an area of water (body of water) comprises at least one platform which has at least one floating body or which forms the floating body itself, the floating body being designed such that it always holds an assembly upper side of the platform above the water level in order to be able to mount the electrical and/or mechanical and/or pneumatic structural elements on a surface of the assembly upper side.

The platform furthermore comprises at least one anchoring element which is mounted on a floor region of a body of water below the platform and distanced therefrom, i.e. below the water level.

In this case, both the anchoring element and the platform each have at least one magnet element such that the platform is held in the vertical direction by the anchoring element preferably only by the magnetic force that is generated between the two magnet elements.

According to at least one embodiment, the magnet element, the anchoring element and/or the magnet element of the platform are rotatable around a vertical axis. In other words, both magnet elements can be rotated relative to one another around this vertical axis. Such a rotation can in particular lead into a full rotation of the platform since the magnet element is mechanically connected to the remaining elements of the platform. A revolution of the magnet element can therefore also mean a corresponding synchronous revolution of the platform around the anchoring element and around this vertical axis.

According to at least one embodiment, the magnet element is an electromagnet. In such a case, it must be ensured that the magnet element of the anchoring element mounted in the water is in particular electrically isolated from the water. To this end, water-tight electrical lines could lead into the body of water from above, i.e. from outside of the body of water in order to supply the electromagnets with electrical power.

According to at least one embodiment, the platform has at least one support plate designed in particular to be flat, which forms the assembly upper side, the support plate being held in a floating manner by the floating body at least partially above the water level and, moreover, at least one tube element being arranged on an underside of the support plate opposite the assembly upper side into which air is, for example, pumpable from outside into the tube element by means of a fluid connection installed in the tube element such that the tube element is at least partially filled with air and in doing so displaces the water of the body of water such that the tube element together with the support plate is lifted in the vertical direction according to the volume and/or pressure of the fluid pumped in and moreover such that the support plate rotates around a tilt axis in the vertical direction or horizontal direction in order to be thereby tilted relative to the water level.

The tube element preferably also has a further valve element by means of which air pumped in via the fluid line can be led back out of the tube element in a controlled manner such that the tube element is correspondingly refilled with the water of the body of water and the support plate moves back in the horizontal direction tilting back around the tilt axis. For example, solar elements can be positioned on the support plate such that a corresponding solar alignment of the solar elements can be carried out by means of a controller and/or regulator, which in particular also comprises a controller and regulator of the fluid to be introduced into the upper element. This can depend on the position of the sun.

According to at least one embodiment, the tilt axis is formed by floating bodies arranged below the support plate. It is, in particular, conceivable for the support plate to be mounted tilting on this floating body. Therefore, in this case, the floating body itself then forms the axis of rotation, namely as the support plate is mounted on an upper side of the floating body and as a result a corresponding support axis is formed.

According to at least one embodiment, the magnet element of the platform is height-adjustable in the vertical direction relative to the floating body such that the magnet element is also movable into the body of water and therefore below the water level. In this respect, a distance between the two magnet elements can be set in the vertical direction by such a height adjustment whereby repulsion or attraction is settable accordingly. Greater proximity of the two magnet elements may then be required if, for example, a flow rate is increased in the body of water such that the danger of the entire platform and in particular the support plate drifting away from the anchoring element seems more likely. However, an increased magnetic force between the two magnet elements prevents such drifting. Alternatively or additionally, the magnet element of the anchoring element mounted in the water is also height-adjustable in the same manner.

According to at least one embodiment, the platform has an opening in which the magnet element is positioned and through which the magnet element is also movable into the body of water and therefore below the water level. Such an opening can in particular be provided in the support plate such that this opening is likewise also arranged in the horizontal direction between two separately arranged floating bodies or an opening arranged overlapping also in the floating body. In other words, the magnet element can, for example, be moved into the body of water both through an opening of the support plate and also through a corresponding opening, arranged directly below, in the floating body.

According to at least one embodiment, the platform has at least two platform openings, in particular which are distinguished from the above-mentioned opening, inside of which respectively one lifting tube element is positioned which is likewise preferably distinct from the above-mentioned tube element and air being pumpable, for example from outside, into each of the lifting tube elements by means of a fluid connection such that at least one of the lifting tube elements is filled at least partially with air, as desired, and in doing so displaces the water of the body of the water such that the lifting tube element is lifted upwards independently of the platform in the vertical direction, the two lifting tube elements being connected to one another with a connection means, in particular a rope, the connection means also being wound around at least one attachment point such that a rotational torque develops at the attachment point in the case of a different height movement of the two lifting tube elements and by way of which the platform rotates in a horizontal direction.

In the case of the height movement of the tube elements presented here, a rotation of the entire platform therefore occurs in the horizontal direction instead of a tilting of the support plate relative to the floating body.

The attachment point can be designed as a fixing point on the support plate or as a fixing point in the body of water. For example, the attachment point is positioned on the support plate, but it also be positioned outside of the platform. The attachment point is, for example, a rollable roller, which is arranged so as to be rotatable, or is another mechanical connection element which can be pulled.

Moreover, the above invention also describes a method for operating a floatingly mounted and/or mountable platform for the assembly of electrical and/or mechanical and/or pneumatic structural elements within an area of water. In this case, the features already disclosed in connection with the device are also disclosed for the method described here and vice versa. The method described here, in particular, has a first step in which a platform according to at least one of the above-mentioned embodiments is provided, the electrical and/or mechanical and/or pneumatic structural elements being put into operation in a second step.

The invention described here will be explained in greater detail below based on figures and corresponding exemplary embodiments.

Different exemplary embodiments of a floatingly mounted and/or mountable platform described here are shown in FIGS. 1 to 3B.

As can be discerned from FIG. 1, the floatingly mounted and/or mountable platform 100 is shown there on which electrical and/or mechanical and/or pneumatic structural elements 1 are positioned. The platform 100 described here, in particular, floats in a body of water.

To this end, the platform 100 has a floating body 3, an assembly upper side 21 of the platform 100 always being held above the water level 4 by means of the floating body 3 in order to be able to mount the electrical and/or mechanical and/or pneumatic structural elements 1 on a surface of the assembly upper side 21. It can also be discerned that an anchoring element 5 is arranged below the water level 4, the anchoring element 5 being distanced from the platform 100, i.e. being mounted on a floor region 51 of a body of water below the water level 4.

Both the anchoring element 5 and the platform 100 each have at least one magnet element 61, 62 such that the platform 100 is held in the vertical direction V by the anchoring element 5 preferably only by the magnetic force that is generated between the two magnet elements 61, 62.

In this case, the magnet element 61 of the anchoring element 5 and/or the magnet element 62 of the platform 100 is rotatable around a vertical axis V1.

The individual magnet elements 61, 62 are static magnets. This means that these magnets are different from an electromagnet.

Figure 2:
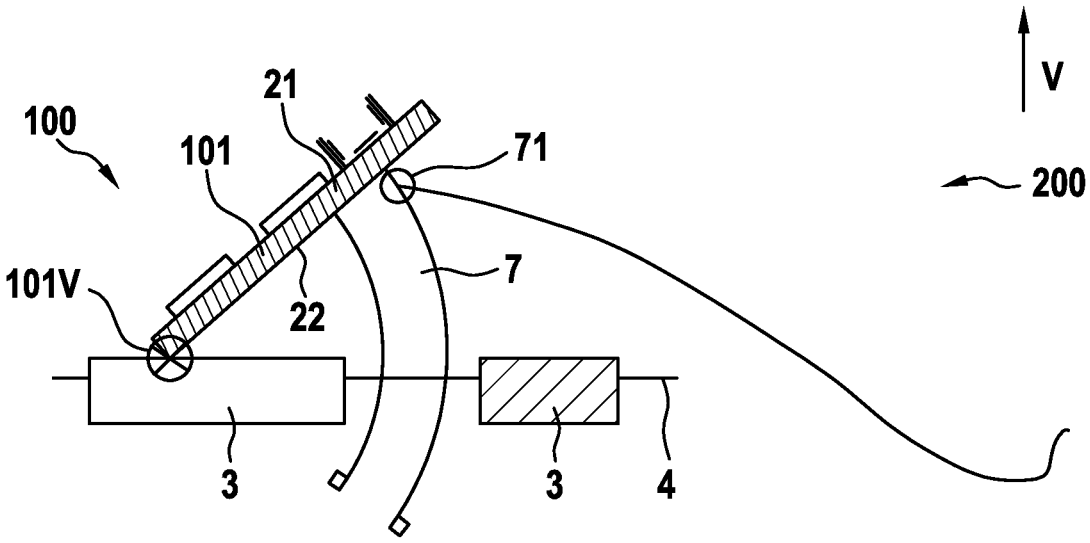

It can be discerned from FIG. 2 in a further schematic embodiment that the platform 100 has a flat support plate 101 which forms the assembly upper side 21.

The support plate 101 is held by the floating body 3 at least partially, but preferably completely above the water level 4, a tube element 7 being arranged on an underside 22 of the support plate 101 opposite the assembly upper side 21 into which air is, for example, pumpable from outside into the tube element 7 by means of a fluid inlet 71 installed in the tube element 7 such that the tube element 7 is at least partially filled with air and in doing so displaces the water of the body of water such that the tube element 7 together with the support plate 101 is lifted in the vertical direction V according to the volume and/or pressure of the fluid pumped in and moreover such that the support plate 101 rotates around a tilt axis 101V in the vertical direction V in order to be thereby tilted relative to the water level 4.

In this case, the tilt axis 101V is formed by the floating body 3 arranged below the support plate 101.

Figure 3:
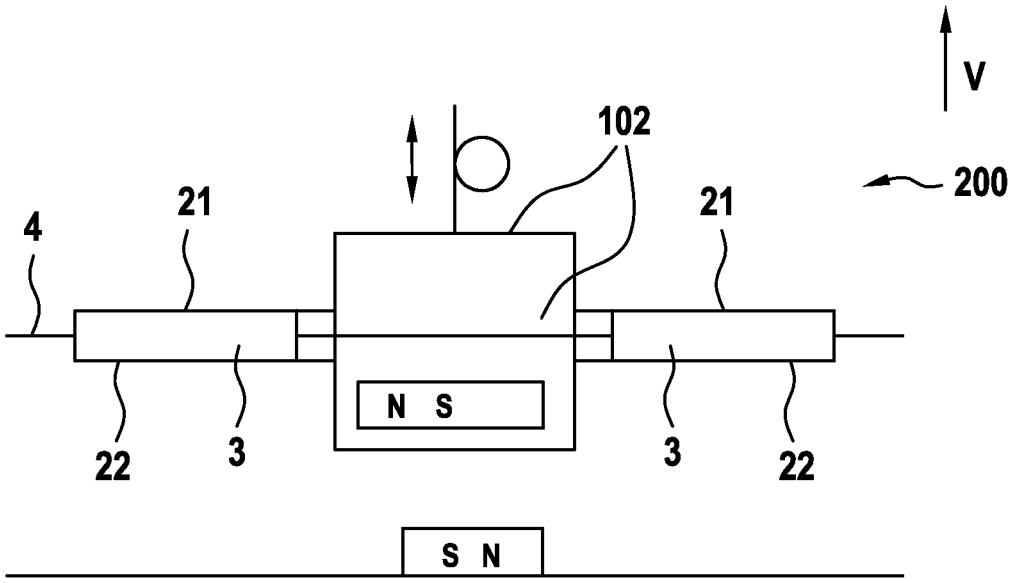

It is shown in FIG. 3 in a further schematic embodiment that the magnet element 62 of the platform 100 is height-adjustable in the vertical direction V relative to the floating body 3 such that the magnet element 62 is also movable into the body of water and therefore below the water level 4.

To this end, the platform 100 has an opening 102 in which the magnet element 62 is positioned and through which the magnet element 62 is also movable into the body of water and therefore below the water level 4.

Figure 3A:
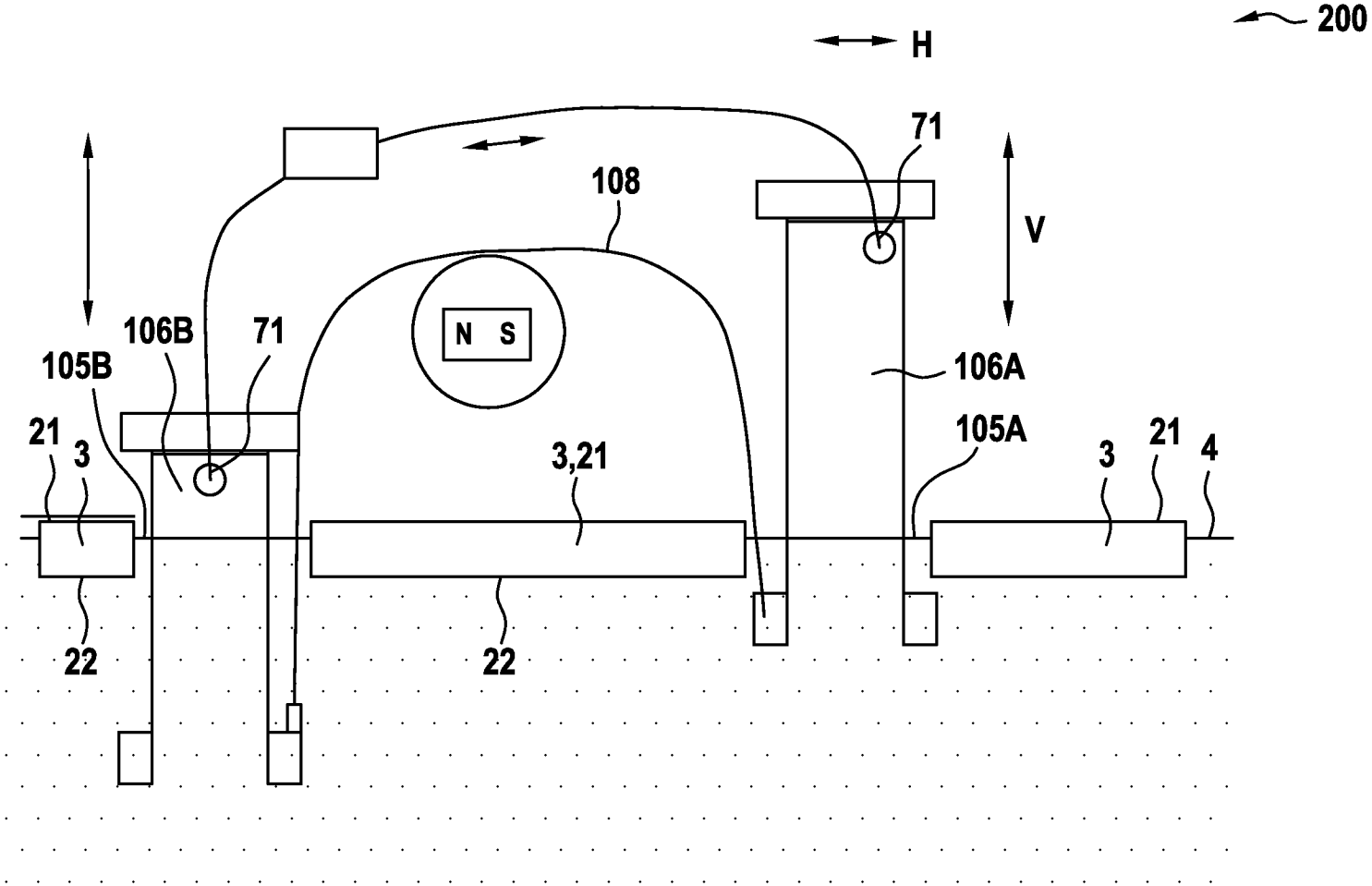
Figure 3B:
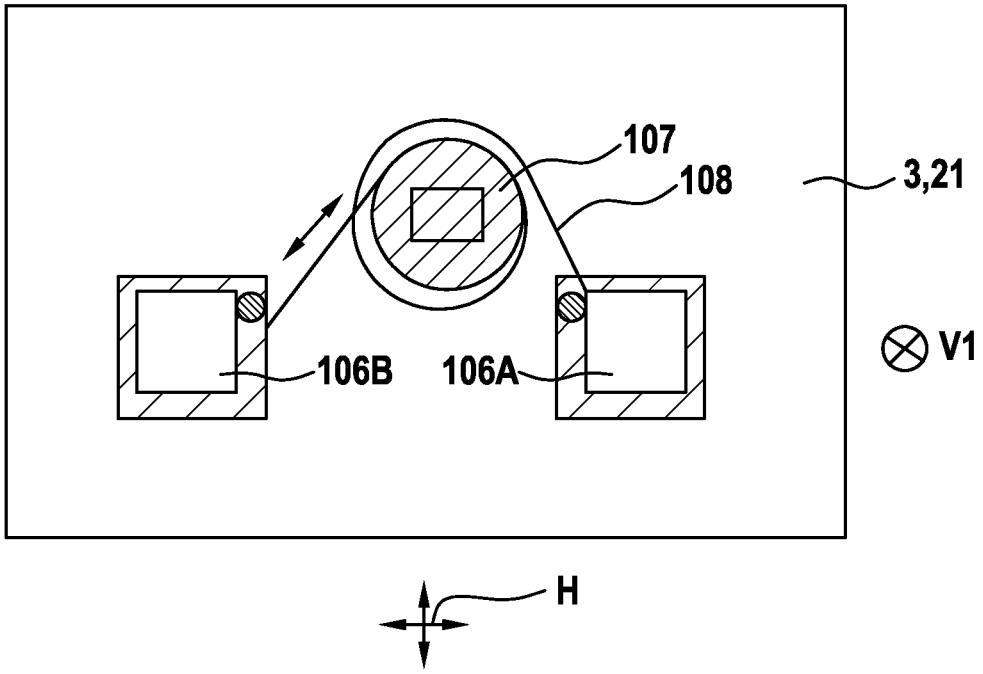

A further exemplary embodiment is shown in FIGS. 3 and 3A and 3B in a schematic embodiment.

In this case, it can be discerned in the side view according to FIG. 3A that the platform 100 has two platform openings 105A and 105B inside each of which one lifting tube element 106A, 106B is positioned and air being pumpable, for example from outside, into each of the lifting tube elements 106A, 106B by means of a fluid inlet 71 such that at least one of the lifting tube elements 106A, 106B is filled at least partially with air, as desired, and in doing so displaces the water of the body of the water such that the lifting tube element 106A, 106B is lifted upwards independently of the platform 100 in the vertical direction V, the two lifting tube elements 106A, 106B being connected to one another with a connection means 108, in particular a rope, the connection means 106 also being wound around at least one attachment point 107 (discernible in FIG. 3B) or being connected in another manner such that a rotational torque develops at the attachment point 107 in the case of a different height movement of the two lifting tube elements 106A, 106B and by way of which the platform 100 rotates in a horizontal direction H.

Such a rotation is in particular shown in FIG. 3B and is indicated by the direction of the arrow. However, it should, in particular be noted that the different embodiments of the figures can also be readily combined with one another such that a platform 100 is conceivable that can perform both a horizontal rotation and a vertical tilt.

The invention has been described with reference to exemplary embodiments. However, it is also apparent to a person skilled in the art that modifications or changes can be made to the invention without departing from the scope of protection of the claims below in doing so.

LIST OF REFERENCE NUMERALS

1 Structural elements
2 Floating body
4 Water level
5 Anchoring element
7 Tube element
21 Assembly upper side
22 Underside
51 Floor region
61 Magnet element
62 Magnet element
71 Fluid inlet
100 Platform
101 Support plate
101V Tilt axis
102 Opening
105A Platform opening
105B Platform opening
106A Lifting tube element
106B Lifting tube element
107 Attachment point
108 Connection means
200 Method
H Horizontal direction
V Vertical direction
V1 Vertical axis

The invention claimed is:

1. A platform for the assembly of structural elements in a body of water, the platform comprising:

a floating platform element having a first magnet element disposed thereon, the floating platform element designed to always hold an upper side thereof above a surface of the body of water; and an anchoring element having a second magnet element disposed thereon, the anchoring element mounted on a floor region of the body of water below the platform element; wherein the floating platform element is held above the anchoring element by a magnetic force generated between the first and second magnet elements.

2. The platform of claim 1, wherein the floating platform element has at least one floating body disposed thereon and designed to always hold the upper side thereof above the surface of the body of water.

3. The platform of claim 1 further comprising structural elements mounted on a surface of the upper side of the floating platform element, wherein the structural elements are selected from the group of structural elements consisting of electrical, mechanical, and pneumatic structural elements and combinations thereof.

4. The platform of claim 1, wherein at least one of the first and second magnet elements is rotatable around a vertical axis.

5. The platform of claim 1, wherein the first and second magnet elements are electromagnets.

6. The platform of claim 1, further comprising:

at least one flat plate pivotally mounted along an edge thereof to a top surface of the floating platform element;

at least one tube element arranged on an underside the at least one flat plate, wherein the tube element is configured to hold air pumpable from outside into the tube element.

7. The platform of claim 6, wherein air is pumpable into the tube element by means of a fluid connection installed in the tube element such that the tube element can be at least partially filled with air and in doing so increases in buoyancy such that the tube element and the at least one flat plate are lifted upwardly so that the at least one flat plate pivots around a tilt axis parallel to the top surface of the floating platform element.

8. The platform of claim 7, wherein the floating platform element has at least one floating body disposed thereon and designed to always hold the upper side thereof above the surface of the body of water, and the tilt axis is disposed on the floating body arranged below the at least one flat plate.

9. The platform of claim 1, wherein the first magnet element is height-adjustable relative to the floating platform element such that the first magnet element is movable to below the surface of the body of water.

10. The platform of claim 9, wherein the floating platform element comprises an opening disposed therethrough, wherein the first magnet element is positioned within the opening and is movable through the opening to below the surface of the body of water.

11. The platform of claim 1, wherein the floating platform element comprises:

at least two openings disposed therethrough;

a tube element disposed within each of the at least two openings and configured to hold air pumpable from outside into the tube element by means of a fluid connection; and a connection means connecting the tube elements disposed within each of the at least two openings, the connection means wound around an attachment point disposed on the floating platform element; wherein a relative change of buoyancy between the tube elements disposed within each of the at least two openings resulting from being filled at least partially with air causes a relative change in height between the tube elements that develops a rotational torque at the attachment point that rotates the floating platform element around a vertical axis.

12. A method for operating the platform of claim 1, the method including the steps of:

providing the platform of claim 1; and mounting a structural element on the platform, wherein the structural element is selected from the group of structural elements consisting of electrical, mechanical, and pneumatic structural elements and combinations thereof.

* * * * *